United States Patent [19]

Vanderpoel

[11] 4,132,873

[45] Jan. 2, 1979

[54] MULTIPOSITION SWITCH

[75] Inventor: Cornelius Vanderpoel, New Fairfield, Conn.

[73] Assignee: General Time Corporation, Thomaston, Conn.

[21] Appl. No.: 778,158

[22] Filed: Mar. 16, 1977

[51] Int. Cl.[2] ..... H01H 23/30

[52] U.S. Cl. ..... 200/6 R; 200/264; 200/318; 200/339

[58] Field of Search ..... 200/6 R, 6 A, 6 B, 6 BA, 200/6 C, 16 D, 153 K, 159 R, 159 B, 264, 277, 6, 292, 339, 318, 321-325; 338/2, 97, 99, 100, 114, 118

[56] References Cited

U.S. PATENT DOCUMENTS

| | | | |
|---|---|---|---|
| 3,806,685 | 4/1974 | Seeger, Jr. et al. | 200/159 B X |
| 3,818,153 | 6/1974 | Arvai | 200/159 B X |
| 3,886,341 | 5/1975 | Forrest | 200/159 B X |
| 3,944,766 | 3/1976 | Wood | 200/264 X |
| 3,979,570 | 9/1976 | Hyodo | 200/264 |
| 3,983,355 | 9/1976 | Hyodo | 200/264 |
| 3,988,556 | 10/1976 | Hyodo | 200/6 A X |
| 4,045,650 | 8/1977 | Nestor | 200/153 K |

*Primary Examiner*—James R. Scott

*Attorney, Agent, or Firm*—Pennie & Edmonds

[57] ABSTRACT

A movable switch contact of a switch for connecting in a circuit at least a pair of stationary contacts which may be the lands or terminal pads of a printed circuit on a printed circuit board includes an actuating member and a bridging portion. The actuating member is supported for movement in at least two directions and the bridging portion is attached for movement with the actuating member. The bridging portion includes a body of a deformable material having a capacity to conduct current and provide electrical continuity between the stationary contacts when the actuating member shall have been moved to a switch closed position. The actuating member may be adapted for movement toggle fashion as well as for sliding movement. Movement of the actuating member toggle fashion may be through snap action and momentarily whereby the return memory of the body causes the actuating member to return to a neutral or switch open position. In sliding movement there is provision of detent means to position the actuating member in one of two or more positions and similarly to the movement momentarily of the actuating member in toggle fashion, the sliding movement of the actuating member may be against a bias force.

7 Claims, 8 Drawing Figures

MULTIPOSITION SWITCH

BRIEF DESCRIPTION OF THE PRIOR ART

The prior art includes forms of switches and describes manners of switch operation whereby a pair of lands or terminal pads of a printed circuit on a printed circuit board may be shorted together or otherwise closed to complete an electrical circuit. Two known forms of switch for use in this environment include a switch block which may be molded to provide a slot recess for receipt of the switch block at the edge of a printed circuit board. A bridging contact in the form of a metallic blade is disposed adjacent the slot recess within the confines of the switch block and serves as the shorting member when the switch block is moved toward the lands or terminal pads by push button or by sliding actuation in one of possibly two opposite directions. Normally, the switch block when used as a push button will be biased by a spring in the direction opposite to the direction of shorting movement of the switch block. Likewise, the slide switch may be similarly biased. Also, each type of switch operation may employ a detent structure for latching a non-biased structure for a more positive and stable shorting operation. Neither type of switch is capable of providing both momentary switch closing operation and switch closing operation over an indeterminate time duration; and, neither type of switch employs a contact blade for shorting operation and which also biases the switch block to the switch open position or neutral position. Further, switches of this type suffer from possibly a far more serious disadvantage, namely, the contact blade is formed by a metallic member which tends over a period of use to abrade the lands or terminal pads so that the printed circuit eventually fails to function.

BRIEF DESCRIPTION OF THE INVENTION

The present invention is directed to an improvement of the structure and operation described above. To this end, the present invention is directed to a switch having an actuating member capable through a bridging portion of providing both momentary shorting across at least a pair of lands or terminal pads carried by a printed circuit board as well as a shorting of the same for an indeterminate period of time. The operation is achieved by a relatively inexpensive movable switch contact, one which provides positive operation over the life of the printed circuit board. The movable switch contact uniquely is formed by an actuating member which is adapted for movement in at least two opposite directions and which supports a bridging portion formed by a conductive body of deformable material. Thus, the conductive body provides a shorting operation when moved to a position juxtaposed the lands or terminal pads. The conductive body, in the adaptation of the actuating member for movement toggle fashion, provides the return force because of the inherent memory to return to its nondeformed configuration from a deformed actuated configuration thereby to return to the switch open position from the switch closed position. Movement of the actuating member in sliding movement also causes a slight deformation of the conductive body which preferably will be a roller providing at least line contact, although the conductive body also may be parallelepipedonal in shape. The shorting operation is a positive operation of the bridging portion. The movable switch contact, as indicated, is capable both of momentary completion of the circuit and completion of the circuit over an indeterminate time duration by a latching or detent structure. In the present embodiment, "momentary" is considered to mean a completion of the circuit by shorting the lands or terminal pads for the period until the actuating member is released and the return memory of the material forming the bridging portion or external bias returns the actuating member to the switch open position.

There has thus been outlined rather broadly the more important features of the invention in order that the detailed description thereof that follows may be better understood and in order that the present contribution to the art may be better appreciated. There are, of course, additional features of the invention that will be described hereinafter and which will form the subject of the claims appended hereto. Those skilled in the art will appreciate that the conception upon which this disclosure is based may be readily utilized as a basis for the designing of other structures for carrying out the several purposes of the invention. It is important, therefore, that the claims be regarded as including such equivalent construction as do not depart from the spirit and scope of the invention.

DESCRIPTION OF THE PREFERRED EMBODIMENT

Figure 1:
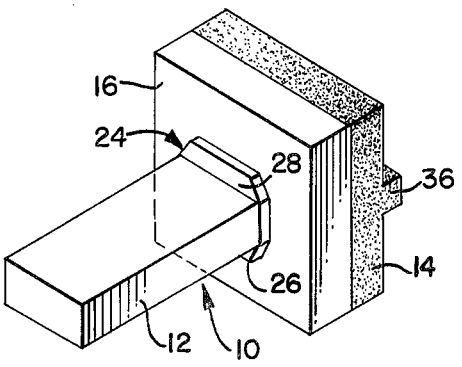
FIG. 1 is a view in perspective of a movable contact of the switch of one form of the present invention.

Turning to the drawing, the movable switch contact 10 may be seen to good advantage in FIG. 1. The movable switch contact includes an actuating member 12, a bridging portion 14 and a base 16 supported by the actuating member and, in turn, supporting the bridging portion. The movable switch contact is capable of adaptation to many possible applications, one such application being in connection with a solid state digital clock whereby actuation of the actuating member will cause the bridging portion to relocate in a position juxtaposed to two or more lands or terminal pads of a printed circuit thereby to provide electrical continuity to initiate the visual presentation of a read-out. The lands or terminal pads are disposed at the ends (not shown) of printed circuits 18, 20 supported on printed circuit board 22 The lands or terminal pads seen in (FIG. 5 and not in FIGS. 2–4 for the sake of clarity, comprise the stationary contacts of a switch. The printed circuit includes the circuits 18*a*, 20*a* connecting with the printed circuits 18, 20 and with electrical components (not shown). The particular arrangement of the printed circuit other than that it includes two or more lands or terminal pads which are spaced apart and between which a circuit is completed by movement of the movable switch contact is outside of the scope of the present invention. To this end, one or both of the printed circuits 18, 20 may be segmented or one of the printed circuits may be continuous in lengths to define a common contact. Other applications of the movable switch contact of the present invention will come to mind as the present description continues.

The movable switch contact of FIG. 1 is capable of operation in toggle fashion. As illustrated, the actuating member 12, base 16 and a plate 24 interposed between may be a multipiece structure or, preferably, formed as a unitary component of one of the conventional polymers capable of being molded. Representative of such polymers which also are capable of displaying characteristics such as sturdiness in operation, longevity of life and others as would be required of an operator which is subjected to handling and manipulation include resins such as amine-aldehyde, urea-formaldehyde, polyester and polyamide resins. A polyamide resin such as nylon presently is preferred. This material, further may be molded to present a substantially smooth surface, one to which the bridging portion may be adhered by use of any of the conventional adhesives capable of bonding the materials described herein to each other.

Figure 2:
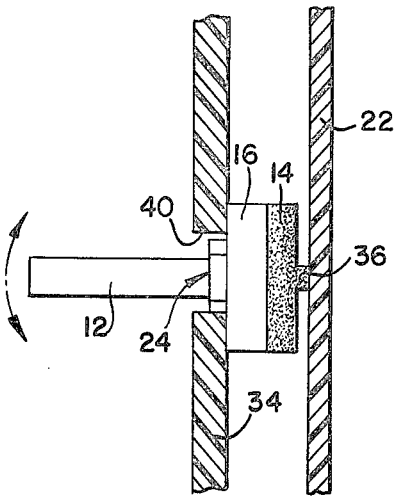
FIG. 2 is a view in side elevation, some of the structure being in section, of the movable contact of the switch of FIG. 1 associated with a printed circuit board, the movable contact of the switch being in a neutral or switch open position.
Figure 3:
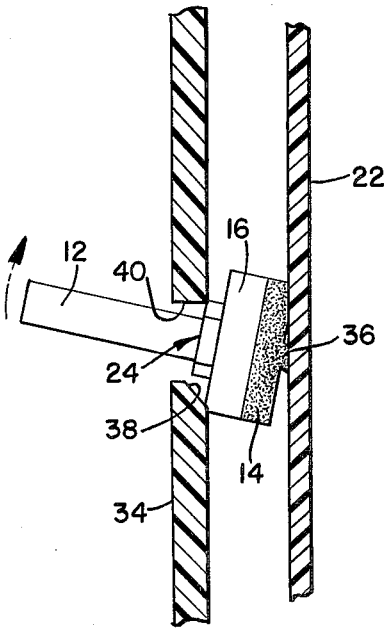
FIGS. 3 and 4 are views similar to FIG. 2 illustrating the movable contact of the switch in switch closed positions whereat there is electrical continuity between lands or terminal pads on the printed circuit board.
Figure 4:
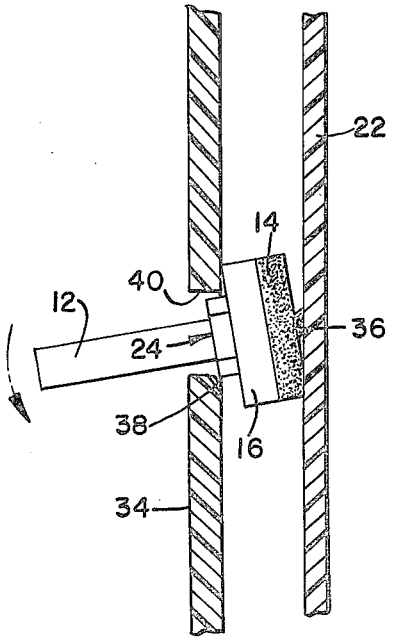
Figure 5:
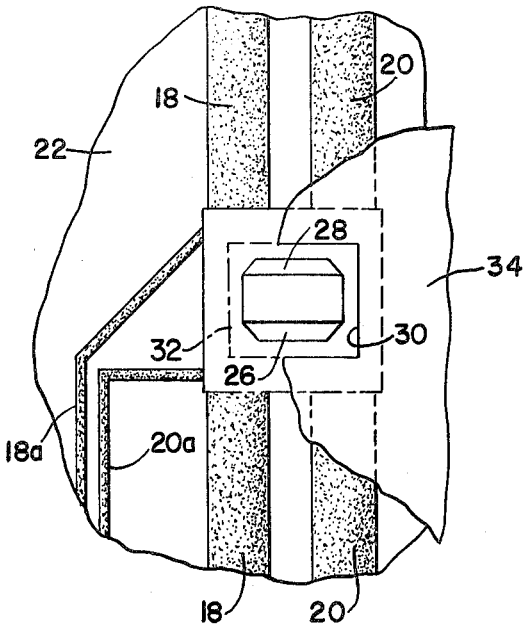
FIG. 5 is a view in front elevation of the movable contact of the switch of FIG. 1 and of the printed circuit board generally illustrating the printed circuit to be closed.

With continued reference to FIG. 1, it may be seen that the plate 24 is of a width substantially equal to the width of the major surface of the actuating member which may be adapted for gripping readily by the operator in moving the actuating member at least in opposite directions denoted by the directional arrows in FIGS. 2–4. The plate includes a pair of shoulders 26, 28 which extend oppositely in the directions of movement of the movable switch contact. The shoulders generally are trapezoidal in outline although any particular outline that will permit the hereinafter discussed operation will suffice.

As illustrated in FIGS. 2–5, the actuating member 12 of the movable switch contact 10 is movable in a pair of mutually opposite directions, the actuating member being guided in this movement by a cooperative interaction between the minor surfaces of the actuating member and surfaces 30 of an opening 32 in clock face 34.

Figure 8:
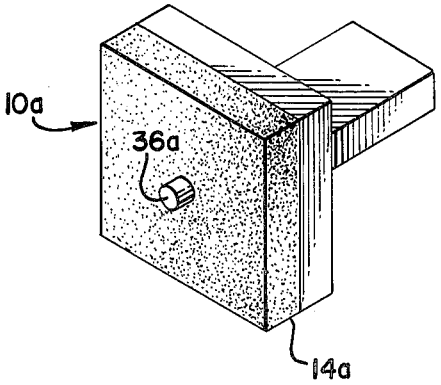
FIG. 8 is a view similar to FIG. 1 illustrating of movable contact of a switch with an extending rod-like bearing member.

The actuating member 12 may have capability of pivotal movement in other directions, as for example, in directions transverse to those directions denoted by the arrow in FIG. 2. In this connection referring to FIG. 8, the movable switch contact 10*a* includes a bridging portion 14*a* providing a bearing member 36*a* having a rod-like configuration. As will be described in connection with FIGS. 1–5, the bearing member 36*a* supports the movable switch contact 10*a* relative to a printed circuit board (not shown but in a manner like that in FIGS. 1–5) and the bridging portion 14*a* provides the return force for returning the actuating member of the movable switch contact to the switch open position from a switch closed position. To accomplish this operation, the opening 32 will take the configuration of a cruciform (not shown) whereby the major surfaces of the actuating member cooperatively interact with surfaces transverse to the surfaces 30.

The movable switch contact 10*a* otherwise is in the form of the movable switch contact of FIGS. 1–5, each of which could be of other construction thereby being equally adaptable for gripping and movement of the actuating member whereby the bridging portion would close a circuit for read-out.

In operation, the actuating member 12 may be moved from a center or neutral position (FIG. 2) selectively to one or the other of two switch closed positions (FIGS. 3 and 4) thereby to complete a circuit, for example, between circuits 18, 20 carried by the printed circuit board 22. Movement of the actuating member will be against a bias force developed at least by the bearing member 36, 36*a* of the bridging portion. To this end, the bridging portion is formed by a body of an elastomeric material capable of being deformed yet having a memory which tends to return the body to the non-deformed relaxed state when not subjected to an external force. Suitable materials include silicone rubber and any of the rubber substitutes such as neoprene, urethane, vinyl and butyl rubber.

The operation contemplates that the bridging portion bridge across spaced electrical contacts and provide electrical continuity for the purpose set out. Accordingly, the body forming the bridging portion will contain a conductive material, such as carbon, silver, gold, tin, conductive oxides, and so forth, which preferably is deposited or impregnated in the finely ground particulate state and in an amount sufficient that a conductive electrical path will be established through the bridging portion from one of the electrical contacts to another. In the presently preferred embodiment, the bridging portion is formed of a silicone rubber body containing carbon or silver particulate. Typical of this construction are the conductive elastomeric contacts disclosed in Seeger, Jr. et al, U.S. Pat. No. 3,861,135.

The bridging portion of the movable switch contact 10 includes a rib 36 which is disposed in the central region, across the region from one side to the other and disposed transverse to the direction of movement of the actuating member. The rib provides a bearing surface against the printed circuit board 22 and, as described above, provides the return force for returning the actuating member to a switch open position (FIG. 2) from a switch closed position.

The bearing members 36 and 36*a* preferably are an integral portion of the bridging portion 14 and 14*a*.

The movable switch contact 10 may be actuated in one direction for momentary closure of the switch and in the other direction for closure of the switch until the movable switch contact shall have been released from the switch closed position. To this end, clock face 34 includes a bevelled cut 38 at one side of opening 32 while the side of the opening opposite thereto remains flat along surface 40. Thus, operative movement of the actuating member 12 to the switch closed position of FIG. 3 results in the tip of shoulder 28 moving beyond the inner surface at the opening whereby the shoulder then being behind the clock face 34 prevents return of the actuating member to the FIG. 2 position when the moving force is removed. However, movement of the actuating member in the other direction permits momentary closure of the switch. Thus, the shoulder 26 freely passes through the bevelled cut 38 and when the moving force is discontinued the memory of the body of bridging portion 14 causes a return to the relaxed state and relocation of the actuating member 12 from the FIG. 4 to the FIG. 2 position. A snap action return by an external force is required for the actuating member to relocate from the FIG. 3 to the FIG. 2 position.

Figure 6:
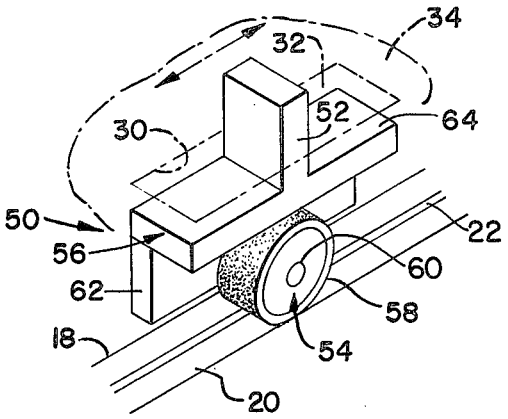
FIG. 6 is a view in perspective of a movable contact of the switch of a second form of the present invention.
Figure 7:
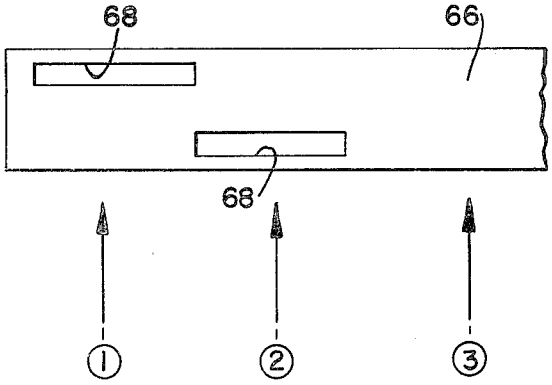
FIG. 7 is a plan view of the deformable member of the second form of the present invention extended linearly.

Turning now to FIGS. 6 and 7, the movable switch contact 50 includes an actuating member 52, a bridging portion 54, and a base 56 for supporting the bridging portion for movement.

The bridging portion 54 in this form of the present invention comprises a roller 58 carried freely on an axle 60 supported by a depending wall 62 of a generally L-shaped base. An upper wall 64 of the base supports the actuating member 52. A ribbon 66 of a material like that of, for example, the bridging portion 14 may be wrapped around and suitably adhered by conventional techniques to the roller 58. The roller, likewise, could be formed entirely of the described conductive deformable material.

As illustrated in FIG. 6, the actuating member 52 is received through an opening 32 in the clock face 34 thereby to be guided in movement to various positions along the opening in one direction or in opposite directions guided by surface 30, as illustrated by the arrow.

As the actuating member moves, the roller is translated in rotational movement to provide by means of the conductive ribbon circuit continuity such as continuity between circuits 18 and 20, as previously described.

The ribbon may include a pattern of cutouts 68 or nonconductive areas whereby movement of the actuator member to various positions may permit varying displays. To this end, the ribbon, turned in FIG. 7 through 180° from that position of its operation, may be of a width to span a number of lands or terminal pads. For example, the ribbon may span two (see FIG. 6) or three lands or terminal pads and, referring to the latter configuration depending upon the position of the actuating member continuity may be established between any two of the same or all three lands or terminal pads. Thus, in position No. 1, the center and an outside land or terminal pad are electrically connected; in position No. 2, the center and the other outside land or terminal pad are electrically connected; while in position No. 3, there is electrical continuity between all lands or terminal pads. The various positions are illustrated in FIG. 7.

Preferably, some positions of actuation movement may be maintained as by detent structure (not shown) and others may be for momentary switch closure by incorporating biasing means (not shown) to return the movable switch contact 50 to a switch open position.

In the present embodiment, the visual display may be provided momentarily or over a longer time duration by selective movement of the actuating member. The visual display may be the same or it may be different dependent upon the circuit energized. If additional contacts are provided as in the case of the additional actuating movement paths of the movable switch contact of FIG. 8, these actuations may conveniently activate other visual displays as the printed circuit may accommodate.

Having described the invention with particular reference to the preferred form thereof, it will be obvious to those skilled in the art to which the invention pertains after understanding the invention, that various changes and modifications may be made therein without departing from the spirit and scope of the invention as defined by the claims appended hereto.

What is claimed is:

1. A switch comprising in combination a movable contact means including actuator means adapted to be gripped and moved selectively in toggle fashion from a switch open position in at least two opposite directions to respective switch closed positions, means for latching said actuating means in one of said switch closed positions, and said actuating means capable of returning to said switch open position following momentary location in said opposite switch closed position, and a bridging member supported by said actuating means, said bridging member including a body formed of a deformable, conductive material; stationary contact means, said stationary contact means comprising a printed circuit board having disposed thereon a printed circuit providing at least a pair of lands bridged by said bridging member when said actuator means is in any of said switch closed positions; and, means providing a surface interacting with said actuating means for restricting movement of said actuating means from said switch open position to one of said switch closed positions at which said body in a deformed state is located in juxtaposition with said pair of lands to establish electrical continuity therebetween, said surface defined by sides of an aperture formed in a plate supported in spaced relation to said printed circuit board, and said body material imparting a bias first to return said actuating means to said switch open position.

2. The switch of claim 1 wherein the material of said body tends to cause said actuating means to return from a switch closed to a switch open position.

3. The switch of claim 1 wherein the body of said bridging member is formed of rubber including therein iron particles providing a conductive path through said body from one land to the other.

4. The switch of claim 1 including a bearing member, said bearing member carried by said body of said bridging member both for supporting said body on said printed circuit board and providing a pivot about which said body is moved to each said switch closed position.

5. The switch of claim 4 wherein said bearing member comprises a rib extending substantially across said body.

6. The switch of claim 4 wherein said bearing member comprises a projection, said projection disposed substantially centrally of said body whereby said actuating means may be moved from said switch closed position in two further opposite directions, said last-named directions being perpendicular to said first directions.

7. The switch of claim 1 wherein said latching means includes a shoulder formed on said actuating means adapted to snap through said aperture, said shoulder then cooperating below said plate to prevent return of said actuating means from said switch closed to said switch open position.

* * * * *